United States Patent [19]

Sakakibara

[11] 4,174,193

[45] Nov. 13, 1979

[54] PERISTATIC PUMP WITH HOSE POSITIONING MEANS AND PRESSURE ADJUSTMENT APPARATUS

[75] Inventor: Kinsaku Sakakibara, Nagoya, Japan

[73] Assignee: Senko Medical Instrument Mfg. Co., Ltd., Tokyo, Japan

[21] Appl. No.: 751,304

[22] Filed: Dec. 16, 1976

[51] Int. Cl.[2] ..... F04B 43/08; F04B 43/12; F04B 45/06

[52] U.S. Cl. ..... 417/477

[58] Field of Search ..... 417/477, 476, 475; 418/45; 251/6, 9; 128/214 F

[56] References Cited

U.S. PATENT DOCUMENTS

| | | | |
|---|---|---|---|
| 487,136 | 11/1892 | Truax | 417/477 |
| 3,396,669 | 8/1968 | Everett | 417/476 |
| 3,762,836 | 10/1973 | De Vries | 417/477 |
| 3,955,902 | 5/1976 | Kyvsgaard | 417/477 |

FOREIGN PATENT DOCUMENTS

| | | | |
|---|---|---|---|
| 2204800 | 8/1973 | Fed. Rep. of Germany | 417/477 |

*Primary Examiner*—Carlton R. Croyle
*Assistant Examiner*—Thomas I. Ross
*Attorney, Agent, or Firm*—Kane, Dalsimer, Kane, Sullivan & Kurucz

[57] ABSTRACT

A liquid transfer pump in which a flexible hose may be arranged along the internal peripheral wall of a semicircular external enclosure and a drive shaft which is rotated by a motor or the like is provided at a position with the equal distance from the internal peripheral wall and a plurality of squeeze rollers which travel around the drive shaft in accordance with rotation of the drive shaft while rolling around their own axis and squeeze out the liquid in the flexible hose while depressing the flexible hose against the internal peripheral wall to transfer the liquid from one position to another position is rotatably supported by a holder fixed to the drive shaft, wherein the internal peripheral wall of the external enclosure is slanted and the external peripheral surfaces of the squeeze rollers opposite to the internal peripheral wall are made parallel with the internal peripheral wall.

5 Claims, 15 Drawing Figures

PERISTATIC PUMP WITH HOSE POSITIONING MEANS AND PRESSURE ADJUSTMENT APPARATUS

BACKGROUND OF THE INVENTION

Conventionally, this type of pump has been designed only to adjust the quantity of liquid to be transferred through adjustment of the rotating speed of the squeeze rollers by controlling the rotation rate of the motor and has been unable to adjust the quantity of liquid without varying the rotation rate of the motor.

Particularly, the liquid transfer pump for an artificial kidney to transfer blood requires the capability of adjusting the quantity of liquid without varying the rotation rate of the motor.

SUMMARY OF THE INVENTION

The first object of the present invention is to provide a liquid transfer pump capable of adjusting the quantity of liquid to be transferred without varying the rotation rate of the motor which drives the squeeze roller.

The second object of the present invention is to provide a liquid transfer pump with high efficiency of operation.

The third object of the present invention is to provide a liquid transfer pump which has a simple construction and may be easily manufactured and is economically advantageous.

Other objects of the present invention are disclosed in the following detailed description.

The present invention provides a liquid transfer pump in which a flexible hose can be arranged along the internal peripheral wall of a semi-circular external enclosure and a drive shaft which is rotated by a motor or the like is provided at a position with equal distance from the internal peripheral wall and a plurality of squeeze rollers which travel around the drive shaft in accordance with rotation of the drive shaft while rolling around their own axis and squeeze out the liquid in the flexible hose while depressing the flexible hose against the internal peripheral wall to transfer the liquid from one position to another position is rotatably supported by a holder fixed to the drive shaft, wherein the internal peripheral wall of the external enclosure is slanted and the external peripheral surfaces of the squeeze rollers opposite to the internal peripheral wall are made parallel with the internal peripheral wall.

BRIEF DESCRIPTION OF THE DRAWINGS

FIG. 10 (B) is a side view of the plates, and

FIG. 10 (C) is a plan view of the cross section along the line I—I in FIG. 10 (A).

PREFERRED EMBODIMENTS OF THE INVENTION

Figure 1:
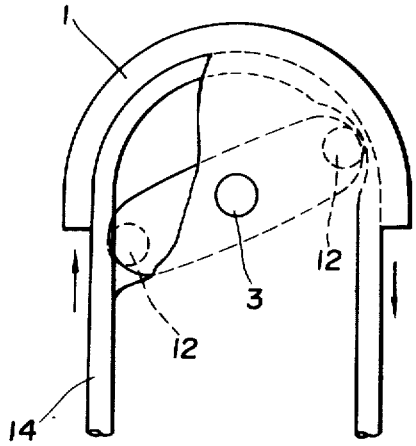
FIG. 1 is a rough plan view illustrating the liquid transfer pump.

The following describes the embodiments of the present invention according to the accompanying drawings.

The semi-circular external enclosure 1 is provided on the container 2 which incorporates the motor or similar well known drive means (not shown) and the internal peripheral wall 1*a* is slanted. The drive shaft 3 which is driven at a low speed by the motor (not shown) incorporated in said container 2 is provided projecting from the upper surface of the container 2 at a position with an equal distance from the internal peripheral wall 1*a*. This drive shaft 3 is made hollow and the cross beam 4 is provided at an internal upper position and the manual handle 5 is secured to the cross beam 4 to permit rotation of the drive shaft 3 by the manual handle 5. The holder 6 which supports the squeeze rollers 12 described later is fixed to the drive shaft 3 so that it rotates together with the drive shaft 3. The holder 6 is made integral with or fixed by screws 9 to the base 7 at the lower side and the arm 8 at the upper side which are provided with the holes 7*a* and 8*a*. The core bars 11 of the cores 10 of the squeeze rollers 12 are rotatably inserted into the holes 7*a* and 8*a*. These core bars 11 are projected from the eccentric position on the cores 10 and the squeeze rollers 12 are slidably mounted on the cores 10. The external peripheral surfaces of the squeeze rollers 12 and the surface of the internal peripheral wall 1*a* of the external enclosure 1 are opposed in parallel with a gap 13 in which a flexible hose 14 which is squeezed by the squeeze rollers 12 along the internal peripheral wall 1*a* of said external enclosure 1 is arranged. The worm wheel 15 is fixed to the core bar 11 projected from the hole 8*a* of said arm 8 to which the worm 16 which engages with this worm wheel 15 is fitted. The set screw 21 projects above the worm wheel 15 from the arm 8 through the long hole 22 of the worm wheel 15 and fixes the worm wheel 15 so that the worm wheel is not moved during operation of the pump.

The external wall 1 is provided with the hose positioning device 17 which comprises the threaded hole 18 which is drilled in parallel with the internal peripheral wall 1*a* from the upper end surface of the external enclosure 1 toward the lower side, threaded bar 19 meshed with the threaded hole 18 and the depressing member 20 fixed to said threaded bar 19 and inserted into the gap 13 to prevent the hose 14 in the gap 13 from floating. The device 17 is designed so that the insertion depth of the depressing member 20 into the gap 13 may be varied by adjusting the threaded bar 19.

The following describes the operation of the above embodiment.

The hose 14 is set in the gap 13 between the internal peripheral wall 1*a* of the external enclosure 1 and the squeeze rollers 12. In this case, the set screw is loosened and the worm wheel 16 is manually turned to adjust the measurement of the gap 13 to a desired value in accordance with the wall thickness of the hose 14 used in the gap 13. In other words, when the worm 16 is rotated, the worm wheel 15 rotates and, when the worm wheel 15 is rotated, the core bar 11 and the core 10 rotate. Since the core bar 11 is projected from the eccentric position on the core 10, the squeeze roller 12 which is slidably and concentrically mounted on the core 10 rotates to vary the clearance of the gap 13. When a suitable clearance is obtained, the set screw 21 is tightened to fix the worm wheel 15. Then the insertion depth of the depressing member 20 of the hose positioning device 17 into the gap 13 is adjusted in order to limit the floating of the hose 14 due to rotation of the squeeze rollers 12 around the drive shaft 3 at a desired height. In the above embodiment, the squeeze rollers 12 and the internal peripheral wall 1*a* of the external enclosure 1 are slanted outwardly and therefore the quantity of the liquid to be transferred increases if the hose 14 is at the upper position of the gap 13. In other words, the longer the length of the hose to be squeezed is, the more the quantity of the liquid to be transferred increases. That is to say, the distance between the external peripheral surfaces of the squeeze rollers 12 which come in contact with the hose 14 and the drive shaft 3 when the hose 14 is located at the upper position of the gap 13 is longer than that when it is located at the lower position and therefore the number of times of rolling of the squeeze rollers 12 around the core 10 increases and the quantity of liquid to be transferred increases. When the drive shaft 3 is rotated at a low speed, the holder 6 firmly fixed to the drive shaft 3 is rotated and, at the same time, the squeeze rollers 12 supported by this holder 6 travel while rolling around their own axis (core 10) to depress the hose 14 against the internal peripheral wall 1*a* of the external enclosure 1 and squeeze the hose 14 to transfer the liquid from one position to another position. In this case, when one squeeze roller 12 parts from the finish end of the internal peripheral wall 1*a* of the external enclosure 1, the other squeeze roller 12 reaches the start end of the internal peripheral wall 1*a* of the external enclosure 1 and therefore the liquid is transferred from one to another position without interruption. The quantity of liquid can be increased by positioning the hose 14 at the upper part of the gap 13 without varying the rotation speed of the motor. In other words, when the insertion depth of the depressing member 20 of the hose positioning device 17 into the gap 13 is reduced, the squeeze rollers travel while depressing the hose 14 and the hose 14 floats up until it comes in contact with the lower end of the depressing member 20 and is squeezed under this condition; and the quantity of liquid to be transferred will increase accordingly. When the drive mechanism is not operating properly of the power supply is shut off, the drive shaft 3 may be rotated by the manual handle 5.

In the above embodiment, the squeeze rollers 12 are slanted outwardly but may be slanted inwardly.

Figure 3:
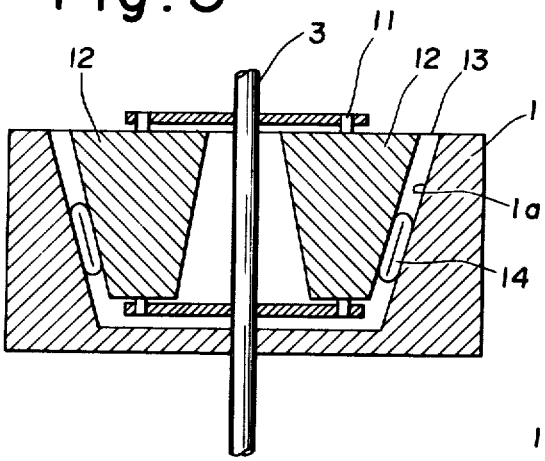
FIG. 3 is a rough front view of the section showing another embodiment of the present invention.
Figure 4:
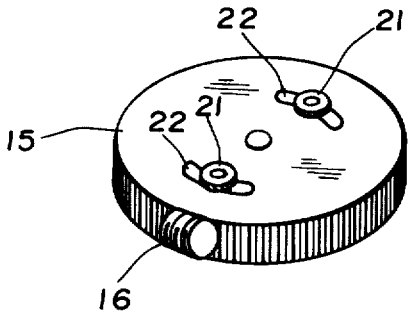
FIG. 4 is a partial plan view illustrating the worm wheel section shown in FIG. 2.

FIG. 3 shows another embodiment in which the conical squeeze rollers 12 are employed. The external peripheral surfaces of the squeeze rollers 12 are opposed in parallel to the internal peripheral wall 1*a* of the external enclosure 1 and the gap 13 maintains the specified clearance even when the squeeze rollers 12 roll around the core 10. The gap 13 may be adjusted to have a specified clearance in which the hose 14 is arranged.

FIGS. 5 to 10 show other embodiments of the present invention.

Figure 5:
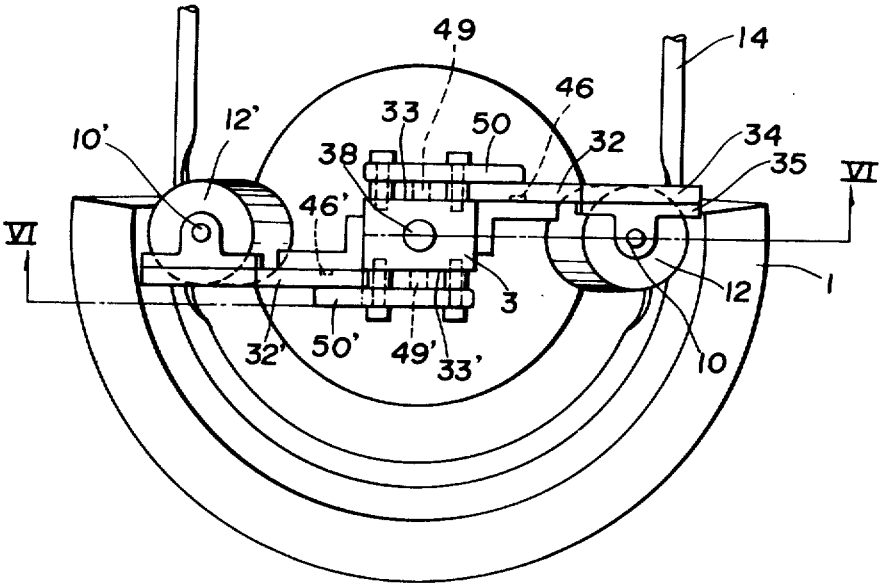
FIG. 5 is a rough plan view illustrating another embodiment of the present invention.
Figure 7A:
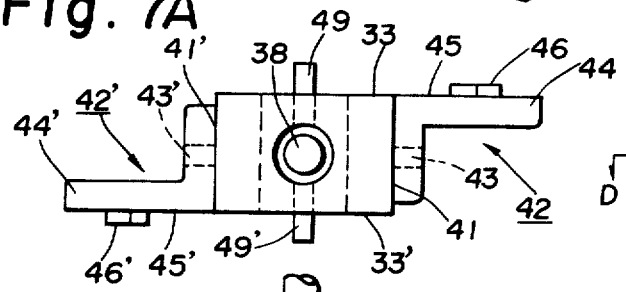
Figure 7B:
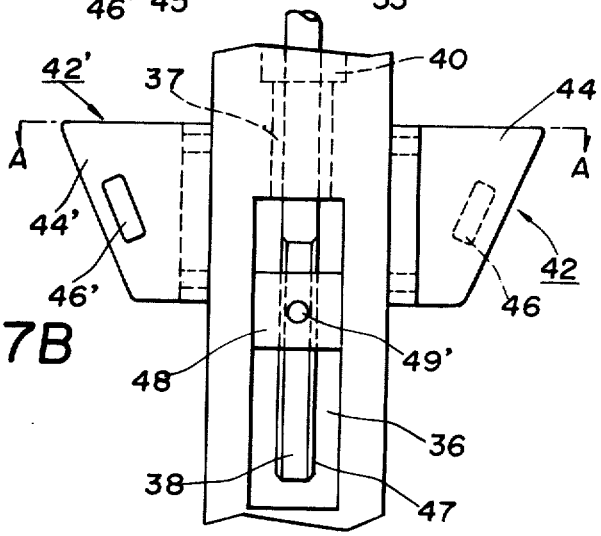

The drive shaft 3 is made as a square column above the bottom 31 of the external enclosure 1 and, as shown in FIG. 5, the liquid is transferred by the squeeze roller 12 which is held at the side face 33 of the drive shaft 3 through the movable vane 32 and the squeeze roller 12' held at the opposite side face 33' of the drive shaft 3 through the movable vane 32'. The axial line of the core 10 of the squeeze roller 12 and the axial line of the drive shaft 3 are arranged to be included in the same plane and the axial line of the core 10' of the squeeze roller 12' and the axial line of the drive shaft 3 are arranged to be included in the same plane. However, the axial lines of the core 10, drive shaft 3 and core 10' need not be arranged to be in the same plane. As shown in FIGS. 7 (A) and (B), the drive shaft 3 has the slot 36 passing through the side faces 33 to 33' at its lower part and the hollow part 37 for insertion of the roller position adjusting rod 38 and the bearing case 40 which stores the bearing 39 at its upper part. The fixed vanes 42 and 42' are fixed at side faces 41 and 41' other than the side faces 33 and 33' of the drive shaft 3. These fixed vanes 42 and 42' have the fixing parts 43 and 43' which are fixed to the drive shaft 3 with screws and the like, vanes 44 and 44' which are projected in a direction at a right angle to the side faces 41 and 41' of the drive shaft 3, slide contact surfaces 45 and 45' which contact the movable vanes 32 and 32' and projections 46 and 46' which are provided on the slide contact surfaces 45 and 45'. The slide contact surface 45 and the side face 33 of the drive shaft 3, and the slide contact surface 45' and the side face 33' of the drive shaft 3 are respectively arranged to be in the same plane.

Figure 6:
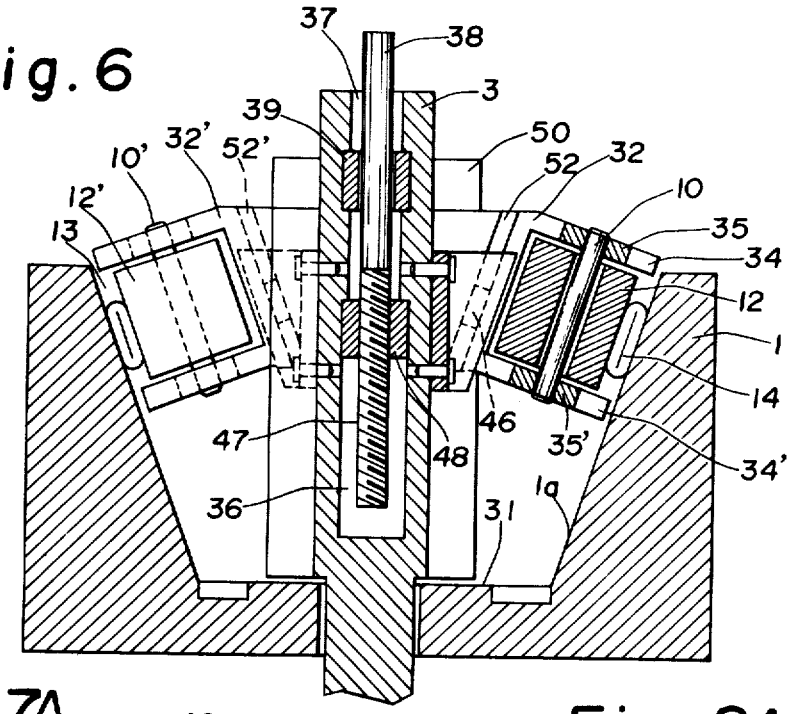
FIG. 6 is a front view of the longitudinal section along the line VI—VI in FIG. 5, FIG. 7 (B) is a partial front view of the drive shaft shown in FIG. 5, FIG. 7 (A) is a plan view of the cross section along the line A—A in FIG. 7 (B), FIG. 8 (A) is a plan view of the roller position adjusting bar 38 taken out from the drive shaft shown in FIG. 5, FIG. 8 (B) is a front view of the longitudinal section along the line D—D in FIG. 8 (A), FIG. 9 (B) is a front view of the moving arm 32 shown in FIG. 5 which is taken out.
Figure 8A:
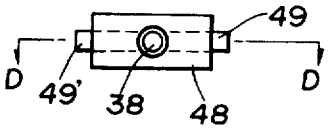
Figure 8B:
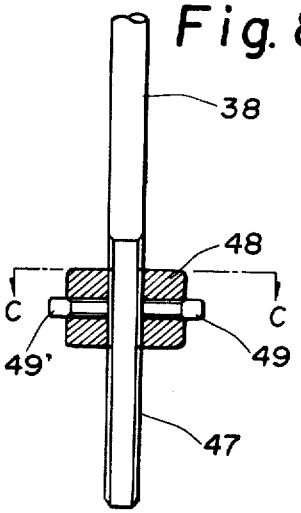
Figure 9A:
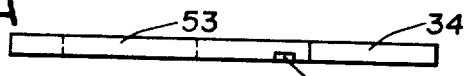
FIG. 9 (A) is a plan view of the moving arm.
Figure 9B:
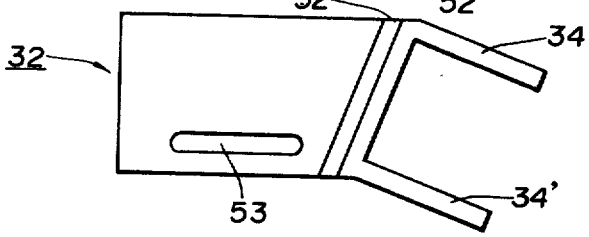
Figure 10A:
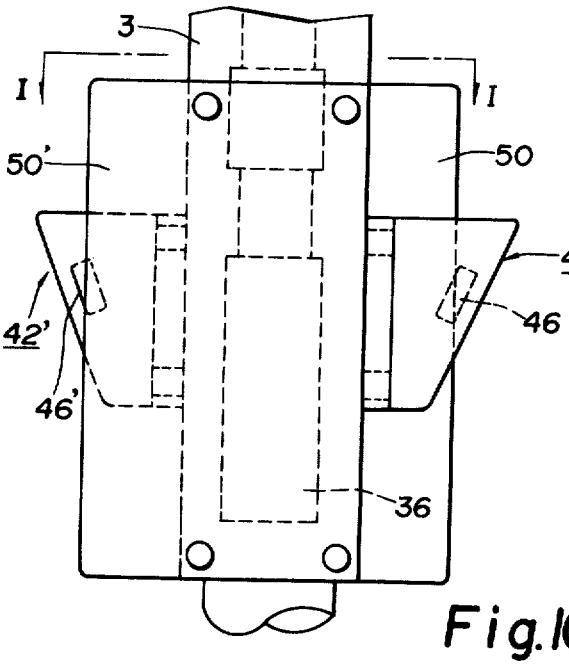
FIG. 10 (A) is a partial front view of the plates 50 and 50' shown in FIG. 5.
Figure 10B:
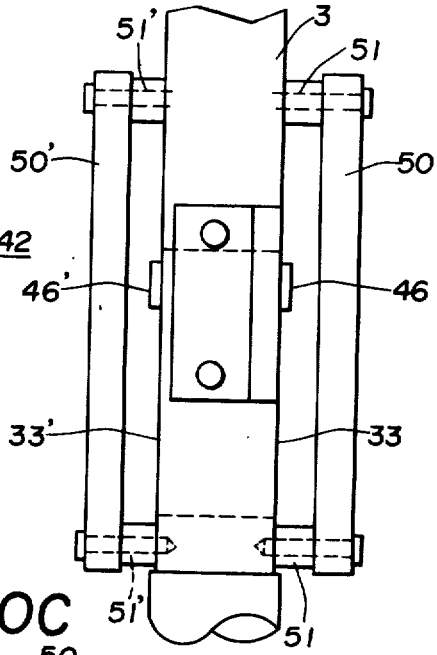
Figure 10C:
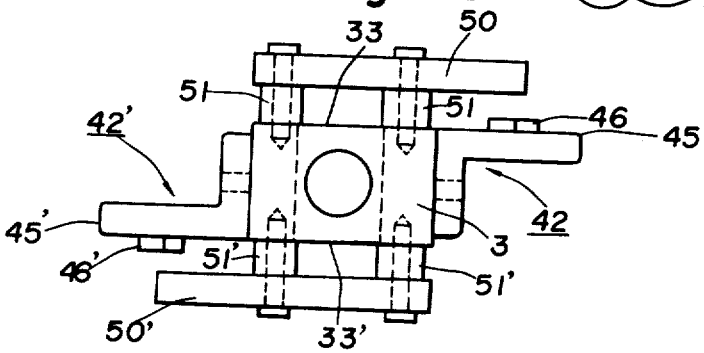

As shown in FIGS. 7 and 8, the roller position adjusting rod 38 with a circular shape of section is inserted into the hollow part 37 and the slot 36 of the drive shaft 3 and moreover the moving block 48 is inserted with less backlash into the slot 36. This moving block 48 is screwed on the screw 47 provided at the lower part of the roller position adjusting rod 38 and is vertically moved by rotation of the roller position adjusting rod 38. The bars 49 and 49' are fixed to the moving block 48 and projected outside the side faces 33 and 33' of the drive shaft 3. Furthermore, as shown in FIG. 10, the plates 50 and 50' are attached with the distance pieces 51 and 51' to the side faces 33 and 33' of the square column part of the drive shaft 3 ranging from the upper part to the lower part, and the plates 50 and 50' and the side faces 33 and 33' are arranged so that the clearance between the plate 50 and the side face 33 and that between the plate 50' and the side face 33' may be constant. As shown in FIG. 9, the movable vane 32 is made of a plate with uniform thickness and has the arms 34 and 34' at one end which are split vertically and support the squeeze rollers, long hole 53 which is extended from the portion near the end of the arms 34 and 34' to the other end and thin long slit 52 provided between the long hole 53 and the arms 34 and 34'. The movable vane 32 is made to have a thickness almost equal to the clearance between the plate 50 and the side face 33 and, as shown in FIGS. 5 and 6, the movable vane 32 is arranged between the plate 50 and the side face 33 so that the bar 49 is inserted into the long hole 53 and the projection 46 is engaged with the long slit 52. When the movable vane 32 is arranged as described above, the long slit 52 is formed in parallel with the internal peripheral wall 1*a*.

Though the projection 46 can be made in a shape which can engage with the long slit 52, the projection is preferably made in a slender shape or in a slender shape whose center is cut off for convenience in smooth vertical movement of the movable vane 32. The movable vane 32' is also arranged between the plate 50' and the side face 33' so that the bar 49' is inserted into the long hole and the projection 46' is engaged with the long slit 52'. The roller holes 35 and 35' are fixed to the arms 34 and 34' and the roller holders 35 and 35' support the squeeze roller 12 so that the axial line of the core 10 of the squeeze roller and the axial line of the drive shaft 3 are included in the same plane. If the condition that the axial lines of the core 10 of the squeeze roller 12 and the axial line of the drive shaft 3 be in the same plane is satisfied, the squeeze roller 12 may be directly mounted on the arms 34 and 34' but the design will be more complicated. The squeeze roller 12 is supported in parallel with the internal peripheral wall 1*a* with a certain specified distance necessary to depress the hose 14 between the squeeze roller 12 and the internal peripheral wall 1*a*. The arms 34 and 34' are supported at closer positions to the internal peripheral wall 1*a* than the squeeze rollers so that the hose 14 may be held between them.

The following describes the operation of the above embodiment of the present invention. When the hose 14 is inserted between the arms 34 and 34' and the roller position adjusting rod 38 is turned by hand, the moving block 48 vertically moves to cause the movable vanes 32 and 32' to vertically move along the internal peripheral wall 1*a* and the distance between the squeeze roller 12 and the internal peripheral wall 1*a* is maintained constant. When the squeeze rollers are adjusted to the specified position, the drive shaft 3 is rotated by the motor etc.

Figure 2:
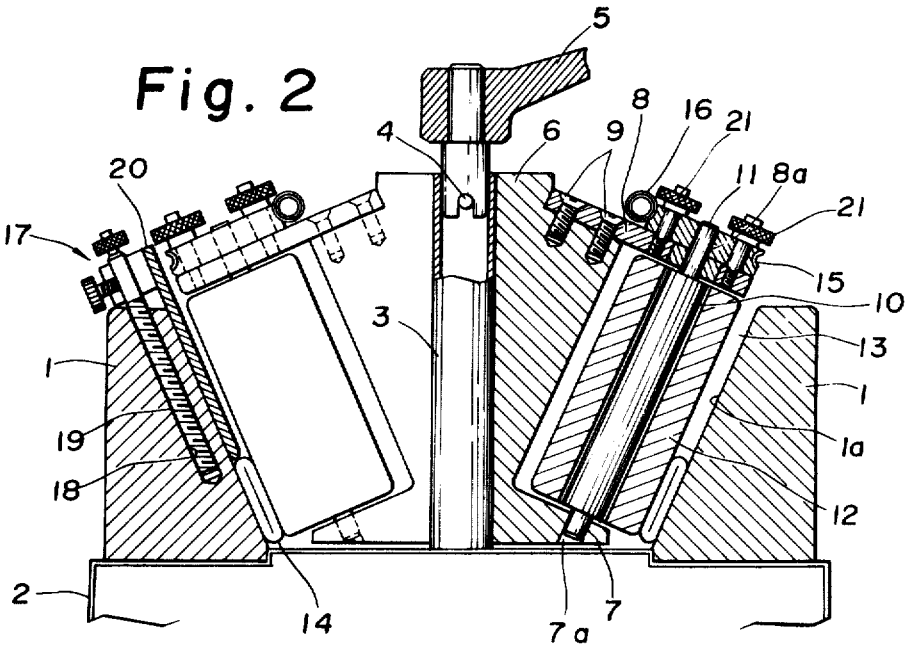
FIG. 2 is a cutaway front view of the liquid transfer pump.

As described in the embodiment shown in FIG. 2, the distance between the squeeze rollers 12 and the internal peripheral wall 1*a* is preferably adjusted by fixing the core bars to the worm wheel at the eccentric position of the cores 10 of the squeeze rollers 12 and rotating the core bars by the worms. Moreover, the drive shaft 3 may be rotated manually by fitting the manual handle to the drive shaft 3.

In the embodiments shown in FIGS. 5 to 10, the projection 46 which engages with the long slit 52 of the movable vane 32 is provided on the fixed vane 42 and may be provided on the side face 33 of the drive shaft 3 of which the sectional area is increased.

In the embodiments, though a liquid transfer pump provided with two squeeze rollers is shown, a liquid transfer pump provided with three squeeze rollers may be manufactured as the embodiments and therefore the present invention includes such liquid transfer pump. In the embodiments shown in FIGS. 5 to 10, the liquid transfer pump provided with more than three squeeze rollers can be manufactured by providing the slot 36, movable vane 32 and others at more than three side faces of a square columnar drive shaft. In this case, the projection 46 should be provided on the side face 33 and the fixed vane 42 has to be removed. Furthermore, the liquid transfer pump provided with more than two squeeze rollers can be obtained as in the above embodiment by forming the drive shaft as a hollow polygonal column and providing a slot from one side face of the drive shaft through the hollow part.

As described in detail, the present invention provides the liquid transfer pump in which a flexible hose can be arranged along the internal peripheral wall of the semicircular external enclosure, the drive shaft which is driven by the motor etc. is provided with an equal distance from the internal peripheral wall and the squeeze rollers which travel around the drive shaft while rolling around their own axis in accordance with rotation of the drive shaft and squeeze the hose while depressing the hose against the internal peripheral wall to transfer the liquid from one to another position are supported by the holder fixed to the drive shaft, wherein the internal peripheral wall of the external enclosure is slanted and the external peripheral surfaces of the squeeze rollers are arranged in parallel with the internal peripheral wall. According to the present invention, the radius of the traveling squeeze rollers when the hose is arranged along the lower part of the internal peripheral wall differs from that when the hose is arranged along the upper part of the internal peripheral wall and therefore the longer the radius is, the more the quantity of liquid to be transferred increases.

Accordingly, the quantity of liquid to be transferred may be adjusted merely by changing the position of the hose held between the internal peripheral wall and the squeeze rollers without varying the rotation rate of the motor etc. which rotates the drive shaft. Moreover, a simple construction that the internal peripheral wall and the squeeze rollers only are slanted is advantageous in the cost and operation, thus providing distinguished practical effects.

What is claimed is:

1. A liquid transfer pump in which a soft flexible hose is arranged along an internal peripheral wall of a semicircular external enclosure, a drive shaft which is driven by drive means is provided at a position with an equal distance from said internal peripheral wall and a plurality of squeeze rollers, which travel around said drive shaft as a center while rolling around their own axis in accordance with rotation of said drive shaft and squeeze said hose while depressing the hose against said internal peripheral wall to transfer a liquid contained in said hose from one position to another position, are rotatably supported by a holder fixed on said drive shaft, wherein said internal peripheral wall of the external enclosure is slanted and external peripheral surfaces of said squeeze rollers are arranged in parallel with said internal peripheral wall, two core bars being fixed at eccentric positions of both ends of a core of said squeeze roller, a worm wheel to which one of said core bars is fixed, a hole in the holder receiving the other of said core bars and a worm engaged with said worm wheel.

2. A liquid transfer pump in accordance with claim 1, which has a hose positioning device provided with a depressing member which prevents said hose from floating between said squeeze rollers and said internal peripheral wall of the external enclosure.

3. A liquid transfer pump in accordance with claim 1, wherein said drive shaft is provided with a handle for manual actuation.

4. A liquid transfer pump in accordance with claim 1, which is adapted so that a horizontal distance between said internal peripheral wall of the external enclosure and said drive shaft at an upper side is larger than that at a lower side

5. A liquid transfer pump in accordance with claim 4, wherein said squeeze rollers are conical in shape.

* * * * *